US010228205B2

(12) United States Patent
Quinn et al.

(10) Patent No.: US 10,228,205 B2
(45) Date of Patent: Mar. 12, 2019

(54) APPARATUS FOR PREVENTING THE RAPID RELOADING OF A SEMI-AUTOMATIC FIREARM

(71) Applicants: Dean Francis Quinn, Palo Alto, CA (US); Daniel Claude Watt, San Jose, CA (US)

(72) Inventors: Dean Francis Quinn, Palo Alto, CA (US); Daniel Claude Watt, San Jose, CA (US)

( * ) Notice: Subject to any disclaimer, the term of this patent is extended or adjusted under 35 U.S.C. 154(b) by 0 days.

(21) Appl. No.: 15/607,400

(22) Filed: May 26, 2017

(65) Prior Publication Data

US 2018/0321005 A1 Nov. 8, 2018

Related U.S. Application Data

(60) Provisional application No. 62/344,975, filed on Jun. 2, 2016.

(51) Int. Cl.
*F41A 17/38* (2006.01)

(52) U.S. Cl.
CPC ..... *F41A 17/38* (2013.01)

(58) Field of Classification Search
CPC ..... F41A 17/38; F41A 9/32; F41A 9/82
USPC ..... 42/18, 70.02, 70.11, 70.08, 1.02
See application file for complete search history.

(56) References Cited

U.S. PATENT DOCUMENTS

| | | | | |
|---|---|---|---|---|
| 8,141,287 | B2 * | 3/2012 | Dubois | F41A 21/482 42/75.01 |
| 8,789,305 | B1 * | 7/2014 | DiChario | F41A 3/66 42/75.03 |
| 9,310,148 | B2 * | 4/2016 | Brown | F41A 17/38 |
| 2014/0223790 | A1 * | 8/2014 | Wilson | F41A 9/65 42/49.01 |
| 2015/0082678 | A1 * | 3/2015 | Jacobson | F41A 17/38 42/8 |

* cited by examiner

*Primary Examiner* — Samir Abdosh
(74) *Attorney, Agent, or Firm* — Belinda Cairns

(57) ABSTRACT

A firearm apparatus is described comprising a firearm upper assembly and a firearm lower assembly, the firearm lower assembly comprising a firearm magazine container, wherein swapping of or refilling of a firearm magazine that is resident within the magazine container necessitates at least partial removal of the firearm upper assembly or may require complete removal of the firearm upper assembly from the firearm lower assembly. Further, such an apparatus requires removal of a firearm magazine retaining device that secures a firearm magazine lock wherein the retaining device is inaccessible without the at least partial removal of the firearm upper assembly from the firearm lower assembly. The firearm lower assembly may have a firearm magazine container that has a closed or partially closed bottom end to prevent switching out of a firearm magazine and the firearm lower assembly may have an opening in the top end sized for receiving a firearm magazine. A new firearm lower assembly is described that has no magazine position button as well as a conversion kit and a method of using a conversion kit to convert a semi-automatic firearm with a readily detachable firearm magazine into a firearm having a non-readily detachable firearm magazine.

17 Claims, 9 Drawing Sheets

200

APPARATUS FOR PREVENTING THE RAPID RELOADING OF A SEMI-AUTOMATIC FIREARM

CROSS-REFERENCE TO RELATED APPLICATIONS

This application claims the priority benefit of U.S. provisional patent application Ser. No. 62/344,975 for "An Apparatus For Preventing The Rapid Reloading Of A Semi-Automatic Firearm" by Dean F. Quinn, et al., filed Jun. 2, 2016, the entire disclosure of which is incorporated herein by reference.

FIELD OF THE INVENTION

The present invention relates in general to semi-automatic firearms. More specifically, the present invention relates to a novel semi-automatic firearm that cannot be rapidly reloaded, a kit for converting an existing semi-automatic firearm with a readily detachable firearm magazine into a firearm that has a non-readily detachable firearm magazine, and a method for this conversion.

BACKGROUND

The United States has gun laws that regulate the sale, possession, and use of firearms and ammunition. Federal gun laws along with most States and some local jurisdictions have additionally imposed their own firearms restrictions. At the present time, California gun laws are known to be some of the strictest in the United States, for example, California has many restrictions and laws pertaining to semi-automatic firearms. One of these laws relates to the detachability of a firearm magazine of a semi-automatic firearm and the ability to rapidly reload a semi-automatic firearm with another firearm magazine while some other State laws regulate the ammunition capacity of semi-automatic firearm magazines. Many firearms including semi-automatic rifles that have readily detachable firearm magazines are prohibited by some States. Such limitations may be due to the potential danger that these firearms may present when in the hands of people who have a desire to harm other people. However, there are many law abiding gun enthusiasts who would relish being able to use currently State prohibited semi-automatic weapons in a responsible manner, for example, for target practice or for hunting.

Many mostly inadequate solutions to this problem have been suggested. One of these proposed solutions uses a magazine release blocking mechanism or a magazine lock such as a BULLET BUTTON®. The BULLET BUTTON® modifies a rifle so that the magazine is not removable by using a simple finger operated magazine position (release) button. It replaces the conventional magazine position button with a small recessed magazine position button that necessitates the use of a small appropriately sized object or tool such as, a bullet, a small screwdriver or other appropriate tools that may be inserted into the recessed magazine release button. The BULLET BUTTON® has been rendered largely ineffective as simply having an appropriate tool at hand or design around tools such as the one described in U.S. Pat. No. 8,776,426 still allows relatively rapid firearm magazine exchange and it does nothing to prevent larger capacity magazines being used.

Another device designed to slow down the time required to reload a semi-automatic firearm is presently described online at: http://www.alloutdoor.com/2014/01/20/lwrc-previews-ca-compliant-magazine-less-ar/. This device comprises a side loading fixed magazine that is filled with individual cartridges, that is, the cartridge or cartridges are inserted into the magazine one at a time through a side opening. Disadvantages of this device include a skilled operator still being able to reload a semi-automatic firearm relatively quickly without requiring any significant firearm disablement where the firearm is visibly disabled for a significant amount of time during reloading periods. Both these and other existing methods fall short of goals designed to prevent the attachment of larger capacity firearm magazines to semi-automatic firearms or to prevent relatively rapid reloading of a semi-automatic firearm as a skilled operator would still be able to reload these modified semi-automatic firearms using the above methods in a relatively quick and efficient manner.

Against the above background, there is a clear need to design a semi-automatic firearm that is unable to be rapidly reloaded. Additionally, such a firearm may be designed to accept only low capacity firearm magazines that cannot be rapidly exchanged in order to diminish the risk posed by such firearms.

SUMMARY OF THE INVENTION

A semi-automatic firearm is described comprising a firearm upper assembly and a firearm lower assembly, the firearm lower assembly comprises a firearm magazine container, wherein swapping of or refilling of a firearm magazine that is resident within the magazine container necessitates at least partial removal of the firearm upper assembly or requires complete removal of the firearm upper assembly from the firearm lower assembly. Further, such an apparatus requires removal of a retaining device that secures a firearm magazine lock wherein the retaining device is inaccessible without at least partial removal of the firearm upper assembly from the firearm lower assembly.

The firearm apparatus above may have a firearm magazine container that has a closed inaccessible bottom end and an opening in the top end sized for receiving a firearm magazine. Refilling of or swapping of a firearm magazine present in the firearm described above necessitates complete removal of the firearm upper assembly from the firearm lower assembly. The firearm magazine and the firearm lower assembly may be made from a resilient material such as a metal or a high impact polymer and the firearm magazine is not easily removed from the firearm lower assembly. The firearm magazine may have a maximum capacity of 100, 30, 20, 10, 5 or 1 round(s).

The firearm apparatus above may be any semi-automatic rifle that has a readily detachable firearm magazine, for example, an AR-15, AK-47, M-14 or AR-10 semi-automatic rifles. The firearm apparatus may be a semi-automatic pistol. The firearm magazine container and the firearm magazine may be combined so that there is no separate firearm magazine. The firearm may be a fully automatic rifle.

The retaining device may be a retaining screw or retaining pin. The firearm device above may have an indicator present in the firearm lower assembly or in the firearm upper assembly to show or indicate how many rounds of ammunition is present within the firearm magazine.

A method is described for converting an existing firearm that has a readily detachable firearm magazine into a firearm that has a non-detachable firearm magazine, comprising, removing an existing functional magazine position button and replacing the functional magazine position button with a dummy or non-functional magazine position button.

A kit for the conversion of a firearm with a readily detachable firearm magazine into a firearm with a non-readily detachable firearm magazine is described comprising, a retaining device; a drill guide template, a modified magazine lock, wherein the shaft or spindle of the magazine lock may have a flattened-out portion to facilitate engagement with the retaining device, a modified magazine position button, wherein the modified magazine button has an optionally threaded hole configured to allow the retaining device to pass through. The flattened out portion of the spindle may optionally have a hole or a dimple to aid in securing the magazine lock. An existing magazine lock without a flattened out portion may be used either with or without a hole in the spindle or shaft so long as it can be secured in the lower assembly without having a propensity to be shaken loose by motion or by the result of firing the firearm (for example, it may be secured by a retaining device or glued in place).

DETAILED DESCRIPTION OF THE INVENTION

The following description is presented to enable a person skilled in the art to make and/or use the invention. Various modifications to the described embodiments herein will be readily apparent to those skilled in the art and the generic principles can be applied to other embodiments. Thus, the present invention is not intended to be limited to the embodiments and examples shown herein but is to be given its widest possible scope in accordance with the features and principles shown and described herein. The particular features and advantages of the invention will become more apparent with reference to the appended figures, taken in conjunction with the following description.

As used herein when referring to firearm magazines, "readily detachable" means removable or exchangeable from a firearm without any significant firearm disassembly, such as having to remove or partially remove an firearm upper assembly from a firearm lower assembly. "Non-readily detachable" or "not readily detachable" as used herein means that significant firearm disassembly is necessary in order to remove or reload a firearm magazine. These definitions should also be consistent with CA proposed bill Assembly Bill, AB1135.

California Assembly Bill AB1664 is also proposing to change the existing definition for a detachable firearm magazine to mean, "an ammunition feeding device that cannot be removed readily from [a] firearm without disassembly of the firearm action, including an[y] ammunition feeding device that can be removed readily from the firearm with the use of a tool.

A semi-automatic firearm is exemplified in the description and drawings by reference to an AR15 semi-automatic rifle but this should only be taken as an example and should not be construed as limiting the wide scope of the inventive concept described herein. Indeed, the inventive concept described herein can clearly be applied to a vast range of semi-automatic rifles from different manufacturers and also, may be applicable, with no or minor modification to fully automatic rifles, fully automatic pistols and semi-automatic pistols. Such modifications would be obvious to a person of ordinary skill in the art in light of the teachings of the present invention.

Figure 1:
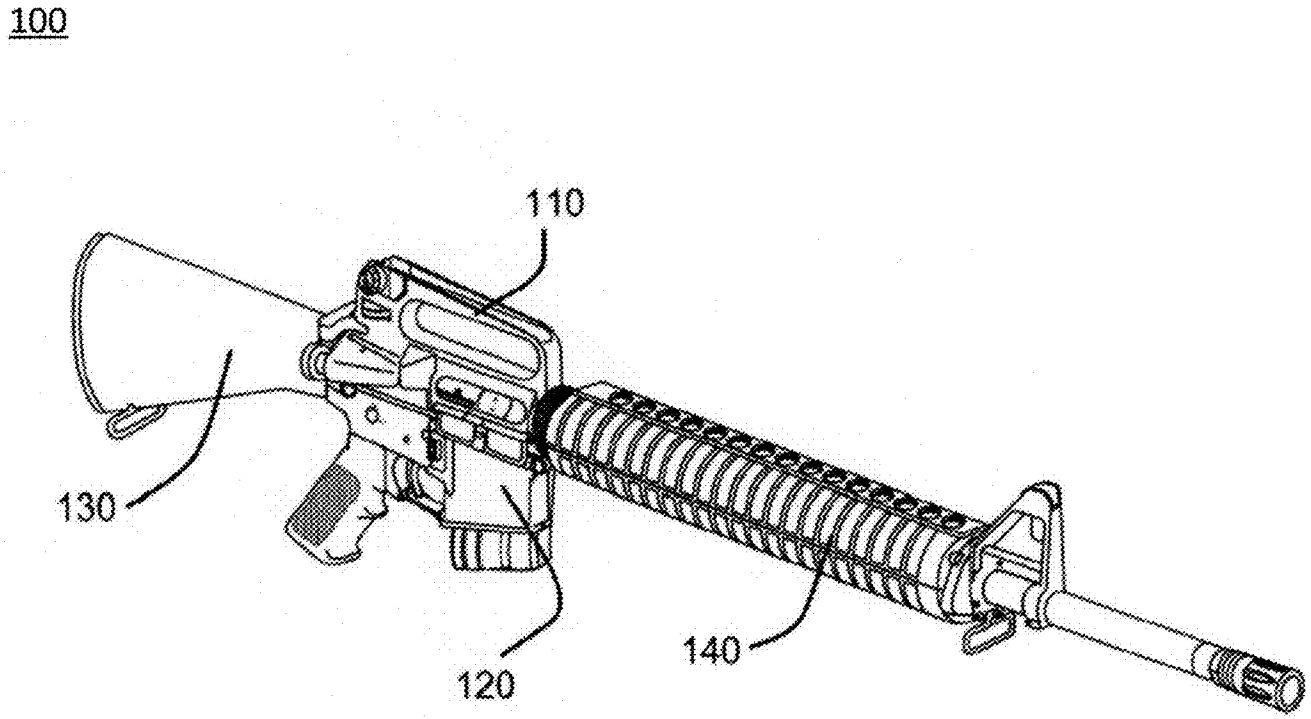
FIG. 1 PRIOR ART
FIG. 1 illustrates the basic components of a semi-automatic rifle.
Figure 2:
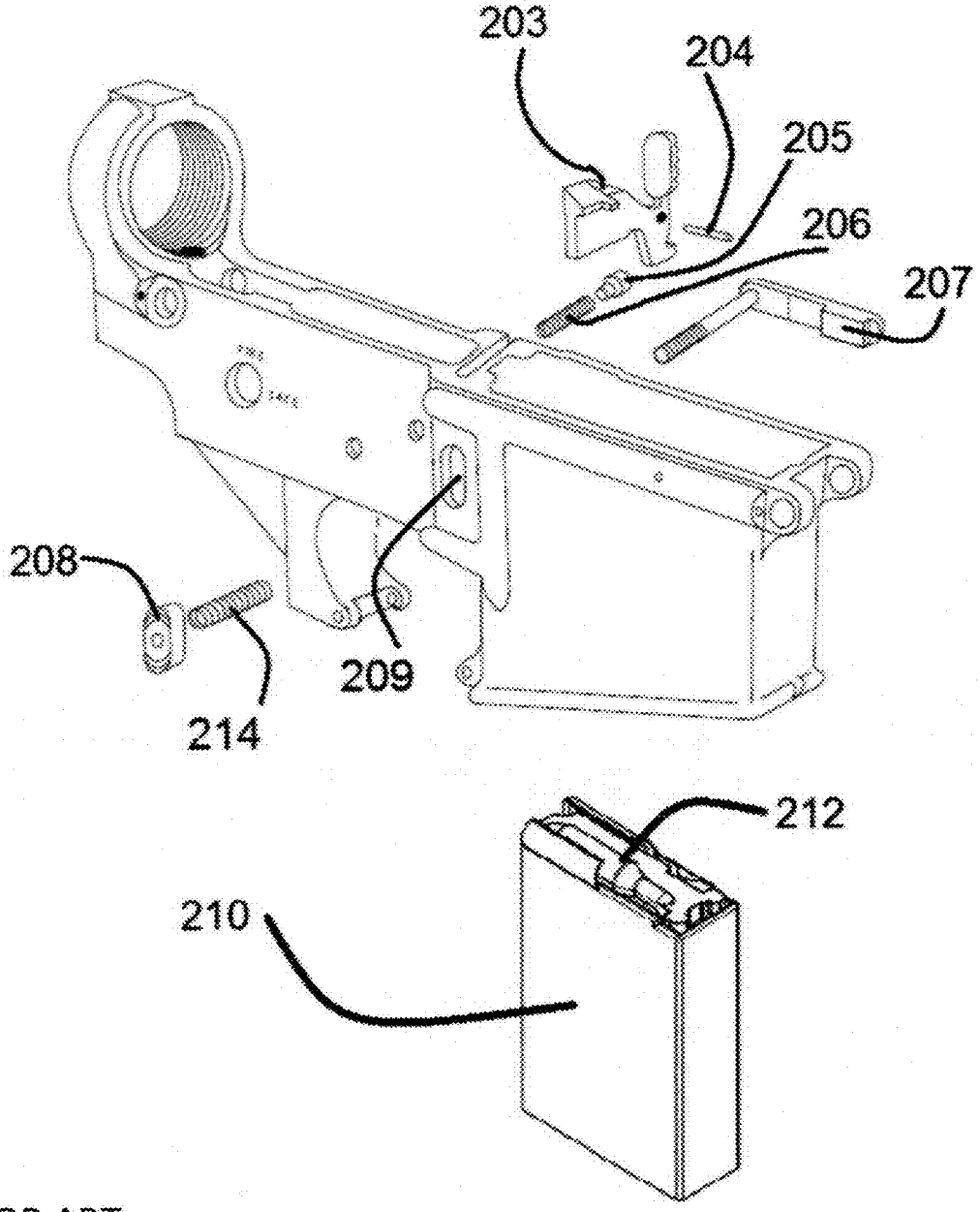
PRIOR ART FIG. 2
FIG. 2 shows an exploded view of a firearm lower assembly of a semi-automatic firearm.
Figure 3:
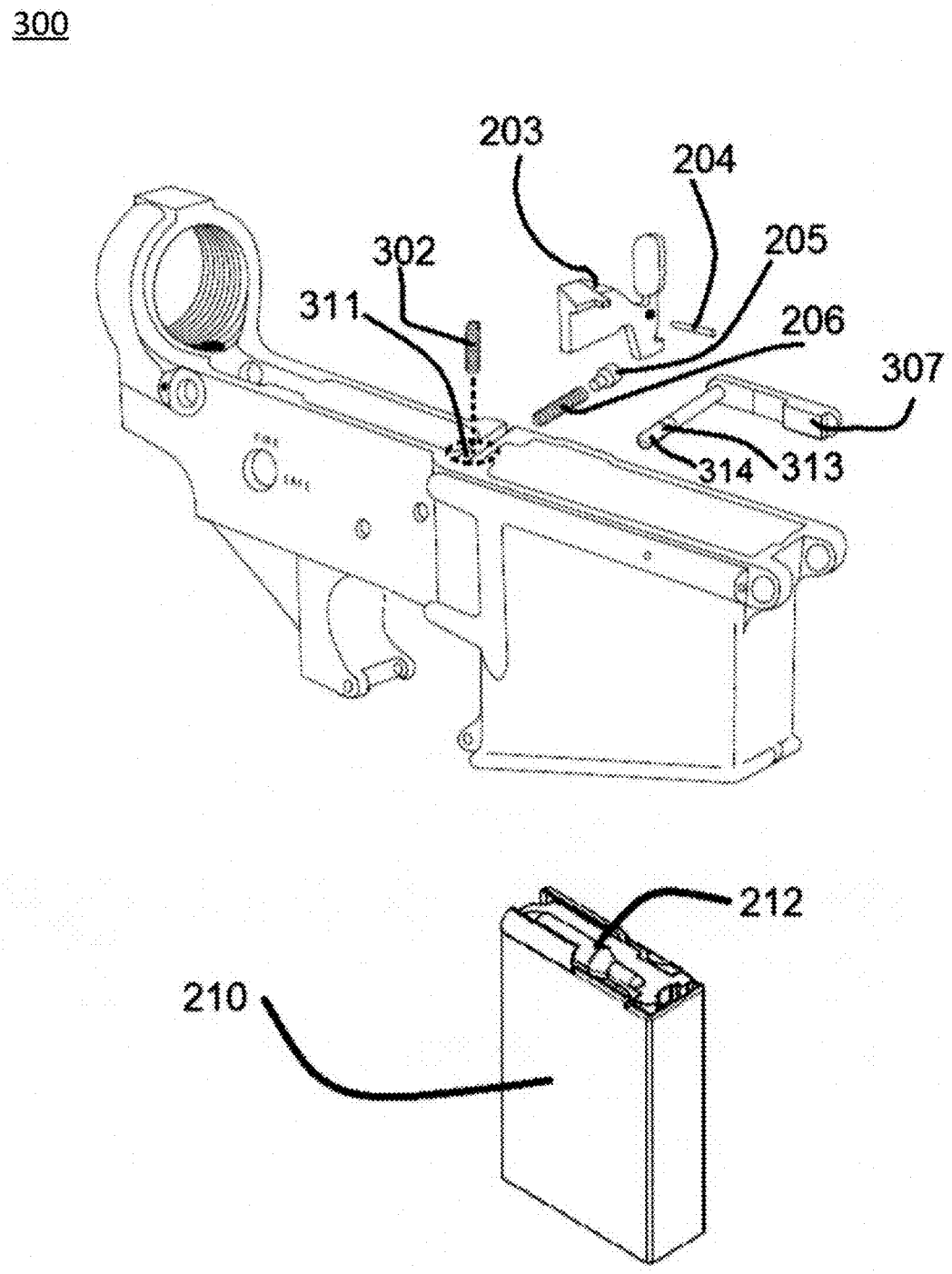
FIG. 3 shows an exploded view of a novel firearm lower assembly.
Figure 4:
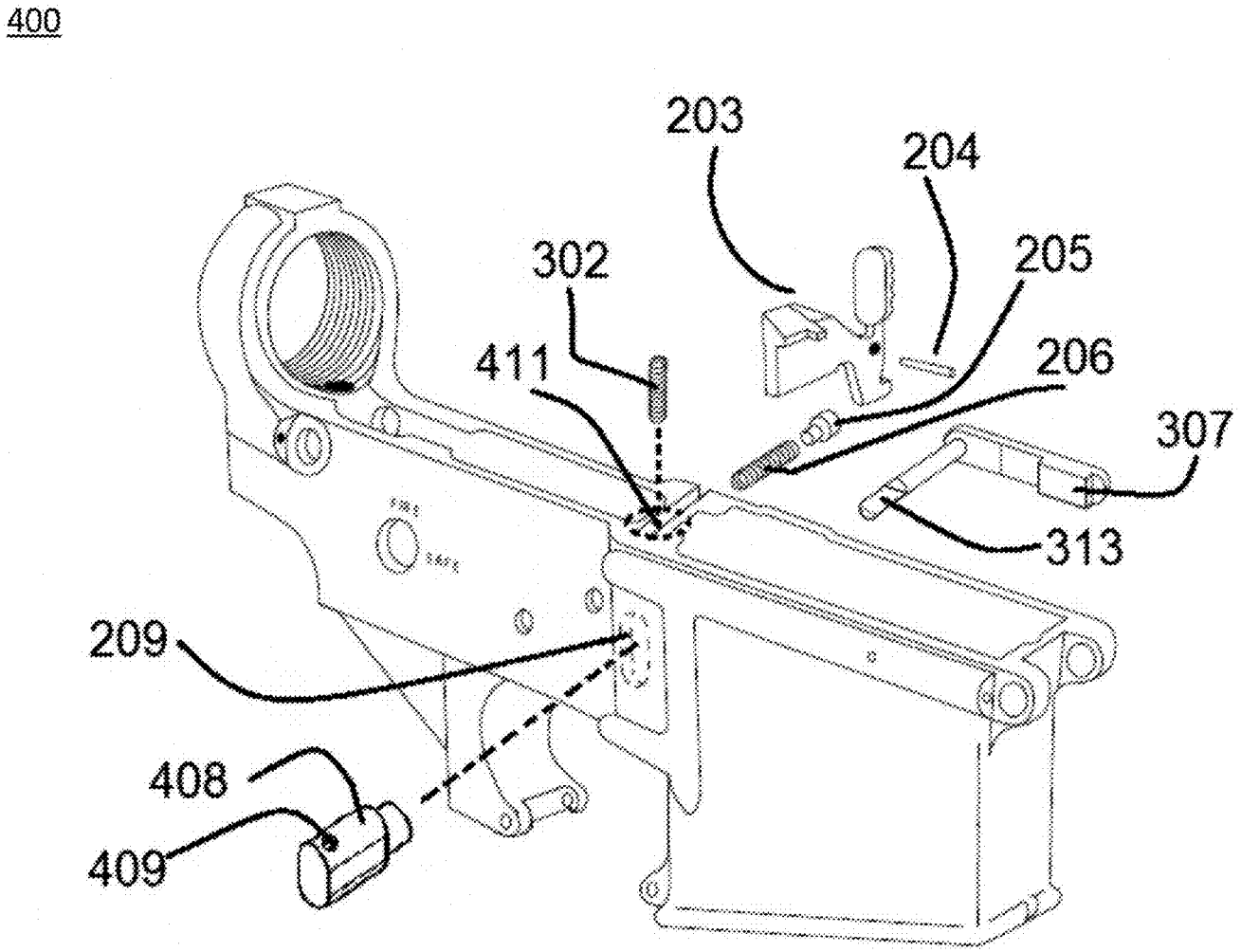
FIG. 4 shows an exploded view of a kit-modified firearm lower assembly.
Figure 5:
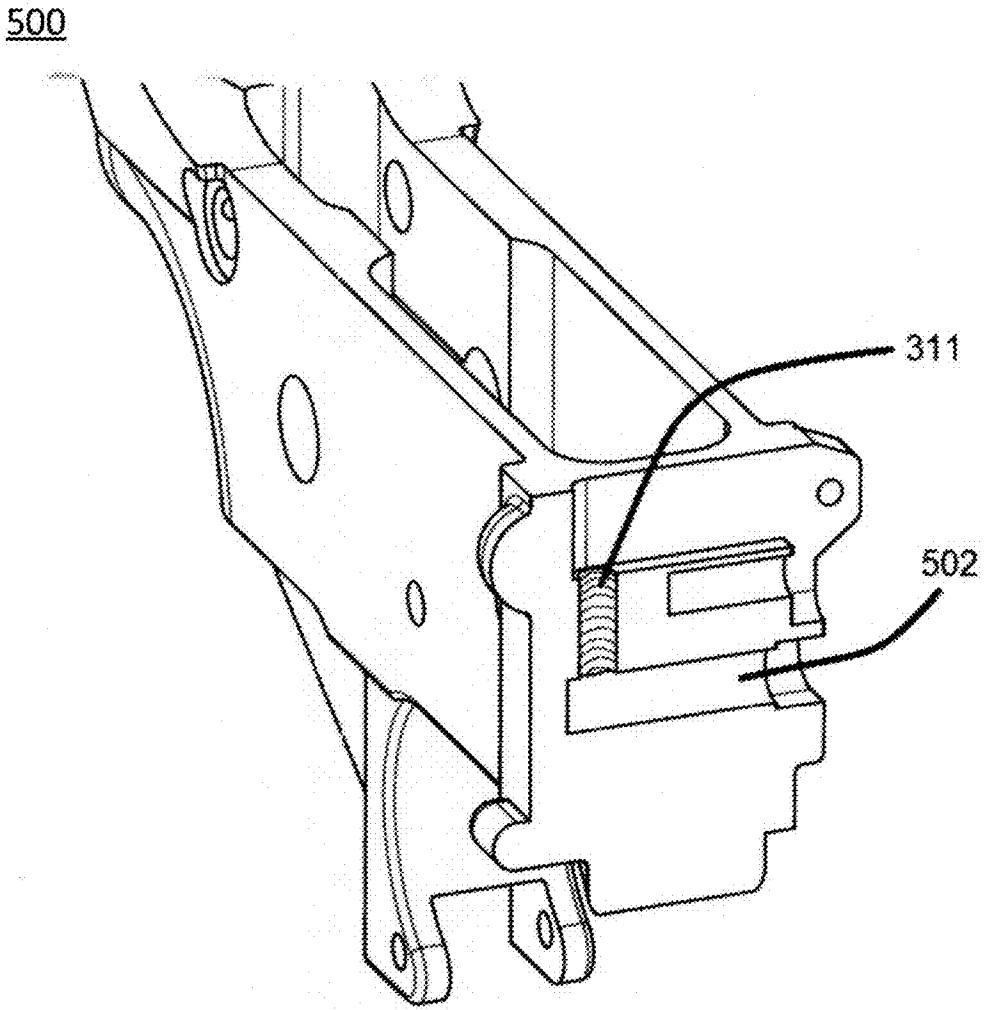
FIG. 5 shows a close up view of a novel firearm lower assembly.
Figure 6:
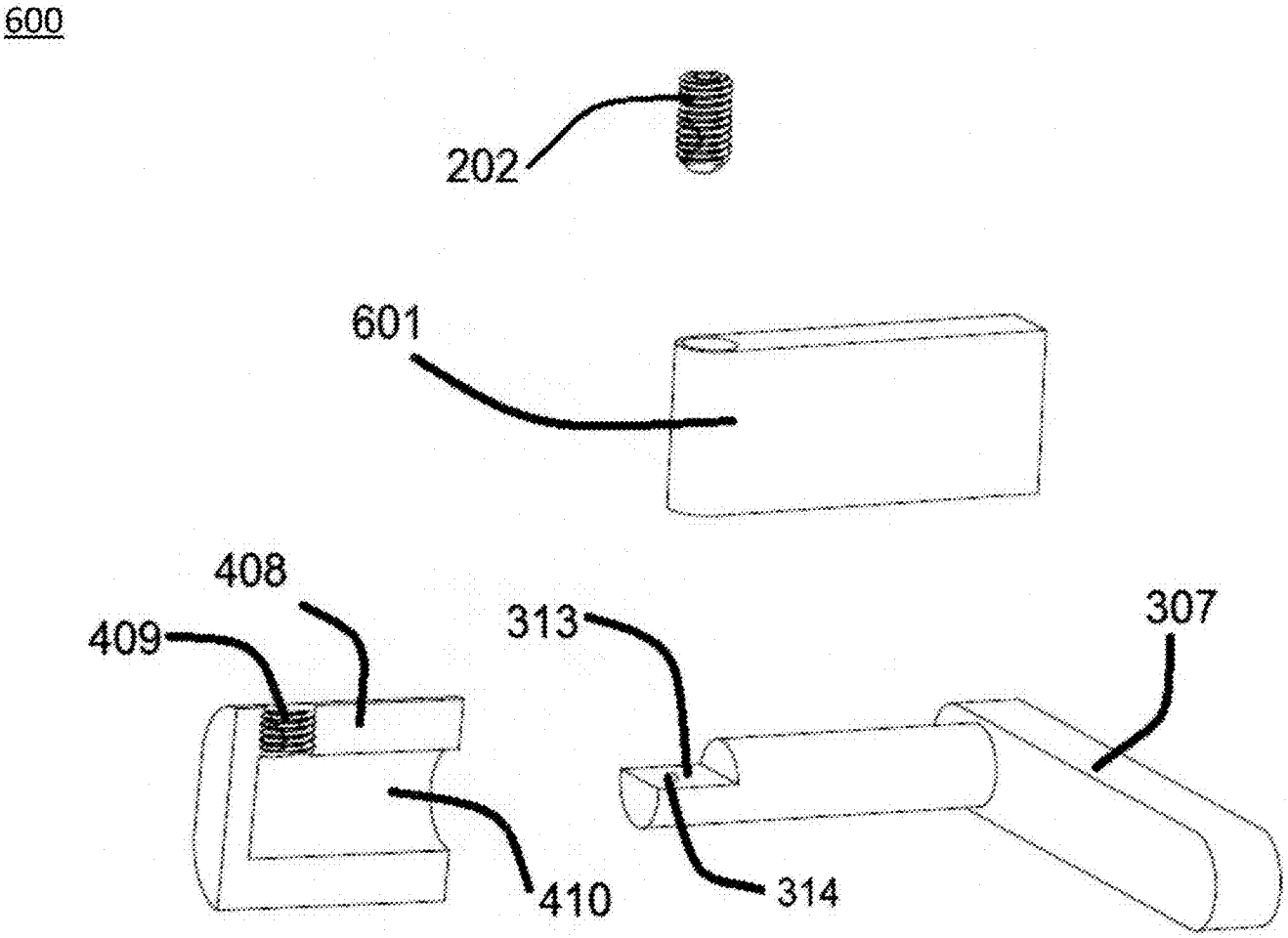
FIG. 6 shows kit components necessary to convert a lower assembly of a semi-automatic firearm to a kit-modified firearm lower assembly.

In an embodiment of the present invention and referring to FIGS. 1 to 9, a lower assembly of a firearm (for example, a lower assembly of an AR15 semi-automatic rifle) was modified so that it could hold firearm magazines that have a capacity of between one and ten rounds of ammunition (1 to 10 cartridges). A major feature of this embodiment is that a firearm magazine, once installed, in a firearm lower assembly, cannot be removed easily, swapped out easily or reloaded easily without at least partial disassembly of the firearm. For example, an firearm upper assembly has to be at least partially disassembled from a firearm lower assembly and this disassembly procedure should take significantly longer in time when compared with the average reloading time for a readily detachable firearm magazine, for example, when changing a firearm magazine on a semi-automatic rifle that is designed to be rapidly reloaded. This was achieved by omitting (in the new assembly shown in FIG. 3) or incapacitating (as shown in FIG. 4 for a kit converted assembly) a magazine position button 208 and by a introducing a threaded locking screw or retaining screw, 302 that secures a magazine lock 307 in place as shown in an exploded view in FIG. 3.

Optionally, an existing, original magazine lock 207 shown in FIG. 2 may be used without modification, it may be modified or replaced with a magazine lock 307 that has a partially flattened out spindle 313 that may have a hole or dimple 314 as shown in FIG. 3 to facilitate locking magazine lock 307 in place. Retaining screw 302 may have a pointed lower end that meets with dimple or hole 314 when retaining screw 302 is secured in place inserted into hole 311).

One skilled in the art would recognize that access to threaded retaining screw 302 is possible only after partial or complete removal of a firearm upper assembly (for example 110 in FIG. 1) in order to gain access to a top open face 212 of a firearm magazine 210 for the purpose of reloading by inserting at least one round of firearm ammunition. In some embodiments of the present invention, the maximum capacity of 210 may be 10 or less rounds of ammunition or cartridges, or preferably 5 or less rounds of ammunition. Retaining screw 302 may be, for example, a pin, dowel pin, threaded fastener or any type of retaining device or fastening device. The magazine lock 307 in the present invention may have a dimpled or recessed portion in its flattened sectioned that is configured to combine with or accept a screw with a pointed bottom-end, or equivalent pin or fastener. 302 may have a slot in its upper end designed to accept a small flat screwdriver or it may have any one of a combination of well-known screw-heads that have complementary tools configured to be inserted into them. Fastener 302 can be inserted into optionally threaded hole 311 where it can meet with and lock in place a modified magazine lock 307 that has been inserted in hole 302.

As described above, magazine lock 307 may have a hole or partial hole in its flat section. Alternatively, magazine lock 307 may have a hole drilled radially in the spindle to accommodate a pin like retainer that may be inserted into hole 311 which in this case would not be required to be threaded. One skilled in the art would recognize that there are many variations in the way that magazine lock 307 may be secured.

A major purpose of magazine lock 207 is to secure a firearm magazine in the correct place in a firearm lower assembly while at the same time, allowing for a little slack or play for a firearm magazine 210 within the firearm lower assembly. This slack or play is very important as without this, firearms may tend to "jam" more often rendering the firearm at least temporarily inoperable. Another main purpose of magazine lock 207 in conjunction with magazine position button 208 in regular semi-automatic firearms with readily detachable firearm magazines 210 is to provide for quick release of a firearm magazine 210 by pressing magazine position button 208.

Embodiments of the present invention retain the purpose of magazine lock 207 to secure a firearm magazine in place in a firearm lower assembly retaining the necessary "play or slack" in the magazine that minimizes firearm jamming while dispensing with the purpose where the magazine lock 207 in conjunction with magazine position button 208 provides a mechanism for quick release of a firearm magazine.

A new type of firearm lower assembly design is disclosed herein that is illustrated in FIG. 3 where a magazine position button 208 as shown in FIG. 2, and a hole 209 for a magazine position button are no longer present. Although this new lower assembly has no magazine position button 208 it does have a magazine lock 307 that may or may not be modified. In this case, 307 has been secured in place with retaining screw 302. After installation of an appropriate firearm magazine, retaining screw 302 that has been inserted in hole 311 engages with and secures a modified magazine lock 307 that may have partially flattened out spindle as shown in FIG. 3, to facilitate perpendicular or near perpendicular engagement with locking screw 302 when securing the magazine lock 307 in place. On reassembly, a firearm upper (for example, 110 in FIG. 1) completely covers and blocks access to locking screw 302 thereby preventing reloading of the firearm without disassembly or at least partial disassembly of an upper part of a firearm from the lower part of the firearm. 203 also blocks access to 302.

FIG. 4 shows an existing firearm lower assembly that has been modified or converted using a novel "conversion kit". The new kit enables the conversion of a semi-automatic firearm with a functional magazine position button 208 into a firearm that has a non-functional magazine position button 408 FIG. 4 and therefore has no mechanism to rapidly reload or switch out firearm magazines. The kit comprises metal or resilient plastic/polymer components comprising: a modified magazine lock 307, a magazine lock retaining screw 302, a modified magazine position button 408 that serves to seal up/fill a magazine position button hole 209 and a drill guide template 601 that serves to facilitate drilling hole 311.

Instructions provided with the kit describe and illustrate how to perform a conversion of an existing semi-automatic firearm that has a readily detachable firearm magazine into a kit converted firearm that has a non-readily detachable firearm magazine. Magazine position button 408 may optionally have a threaded component 409 that is configured to engage with magazine lock retaining screw 302 that may preclude having hole 411 from being threaded (no tapping of the hole would be necessary in this case as part of the conversion, that is, hole 411 may or may not be threaded). Optional kit components may include a drill bit and a drill depth marker. Magazine position button 408 may be optionally peened or glued in place with the firearm lower assembly. Magazine lock 307 may optionally have a hole or partial hole or dimple 314 in its flat section 313. It may also have a round spindle with a hole or partial hole or dimple.

One skilled in the art would recognize that many variations could be used for retaining screw 302 and magazine lock 307, for example, a small hole could be made in the shaft or spindle of a standard magazine lock into which an appropriately designed locking pin could be perpendicularly inserted in place of 307 and 302.

A major feature of the present invention is to prevent the insertion of a large capacity firearm magazine into a semi-automatic firearm and further, to prevent rapid reloading of a semi-automatic firearm by necessitating at least partial removal of, and optionally, complete removal of, the firearm upper assembly from the firearm lower assembly in order to reload the firearm. This is achieved by either using a new firearm lower assembly that does not have a magazine position button as illustrated in FIG. 3, or by converting an existing semi-automatic firearm with a functional magazine position into a firearm that has a non-functional magazine position 408 as shown in FIG. 4. The magazine position button 408 shown in FIG. 4 is in effect, a "dummy" magazine position button that is not operational, it is fixed in place by retainer 302, it cannot be depressed and therefore it is incapable of releasing a firearm magazine.

Optionally, various measures may be taken in an attempt to make a firearm conversion using the above kit irreversible, or at least to make it difficult to be able to reverse a firearm conversion. For example, using strong peening around and into the modified magazine position button 408 and the casing of the firearm lower assembly. Alternatively, hole 209 may and magazine position button may be enlarged such that they match each other but wherein the original magazine position button would not fit into the enlarged hole and therefore would not be able to properly function if attempts were made to reverse the conversion. One skilled in the art would recognize that other key components and the firearm lower casing may be modified in various ways to achieve this result.

Although embodiments of present invention are largely directed to semi-automatic firearms preferably having low capacity firearm magazines, the present invention should not be limited only to the use of low capacity firearm magazines. The inventive concept herein may be applied to many different types of semi-automatic firearms that contain any size of firearm magazine. One skilled in the art would recognize that the invention described herein may also be applicable to many types of semi-automatic pistols.

Figure 7:
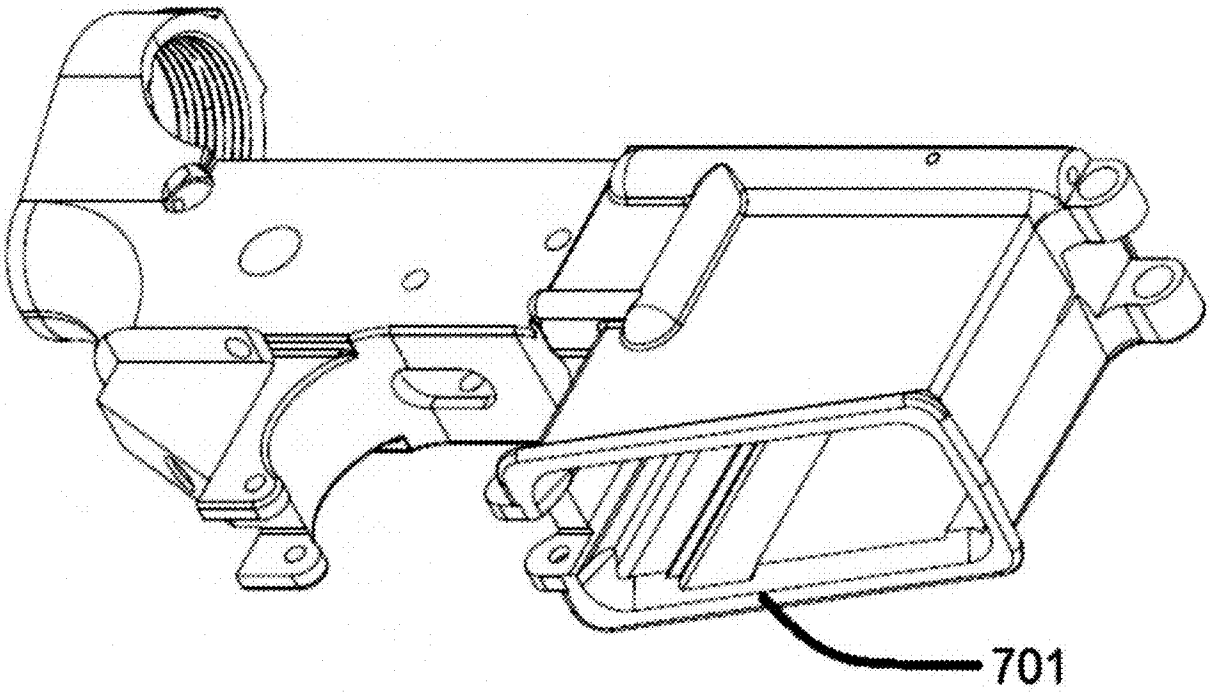
FIG. 7 shows a lower assembly of a semi-automatic firearm with an open-ended magazine container that can accept a firearm magazine inserted in the bottom of the firearm.

FIG. 7 shows an example of a firearm lower assembly, for example, a lower assembly of an AR15 semi-automatic rifle with an existing rimless and open magazine container that has been kit-converted so that it has a non-detachable firearm magazine.

Figure 8:
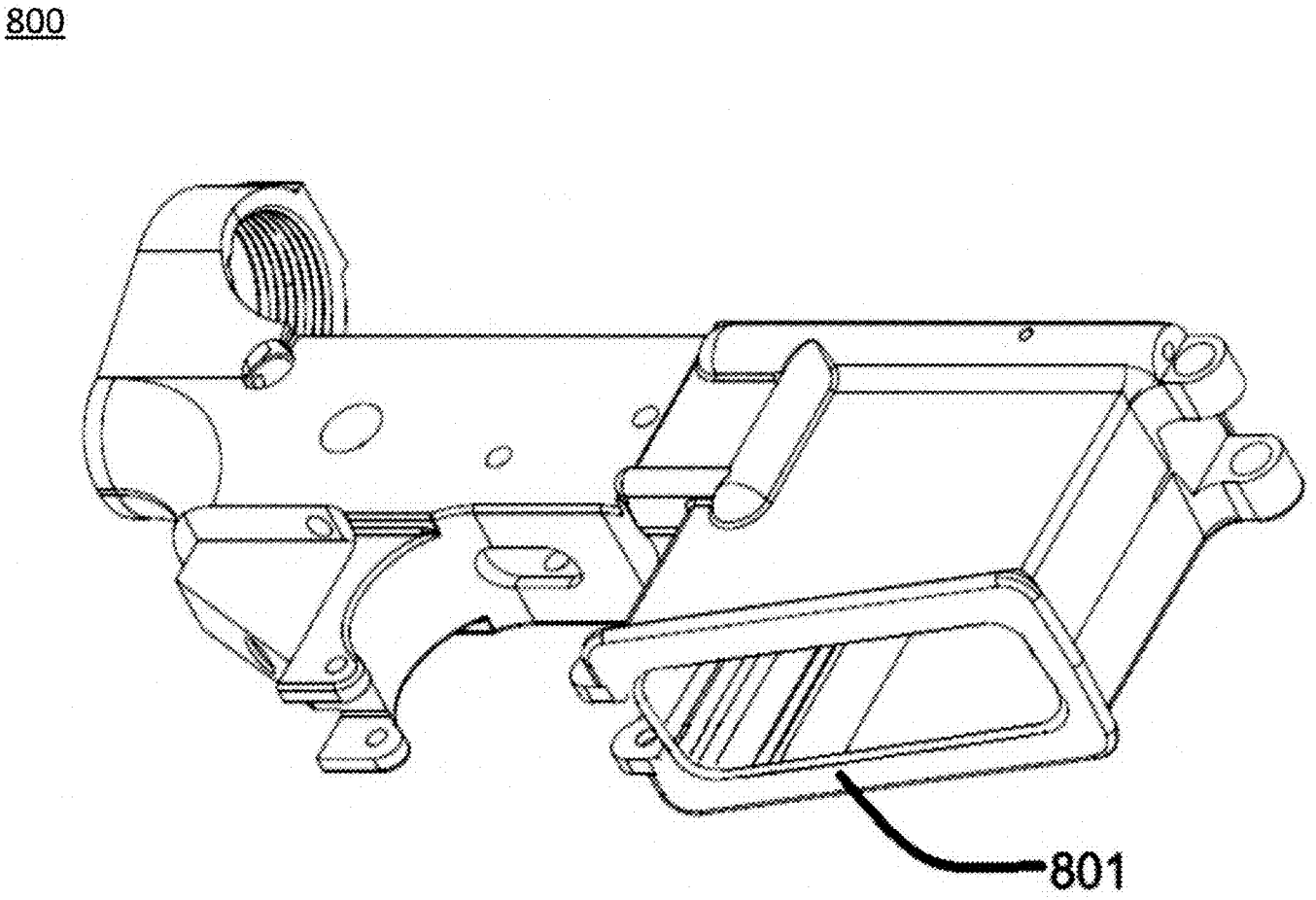
FIG. 8 shows a lower assembly of a semi-automatic firearm with a partially closed bottom that cannot accept a firearm magazine from the bottom of the firearm.

FIG. 8 shows a firearm lower assembly with a rim or lip at the bottom of the magazine container. The rim or lip is designed to prevent a firearm magazine from being inserted from the bottom of the firearm lower assembly while allowing removal of the magazine from the top by, for example, pushing a finger or tool through the bottom hole in order to remove a firearm magazine from the top of the firearm lower assembly (this would still necessitate at least partial removal of the firearm upper assembly). In some embodiments, any size of firearm magazine may be used with this firearm lower assembly bottom rim or lip ranging from 1 to 100 rounds. In some embodiments firearm magazines with 10 or less rounds of ammunition may be used with this firearm lower assembly bottom rim or lip.

Figure 9:
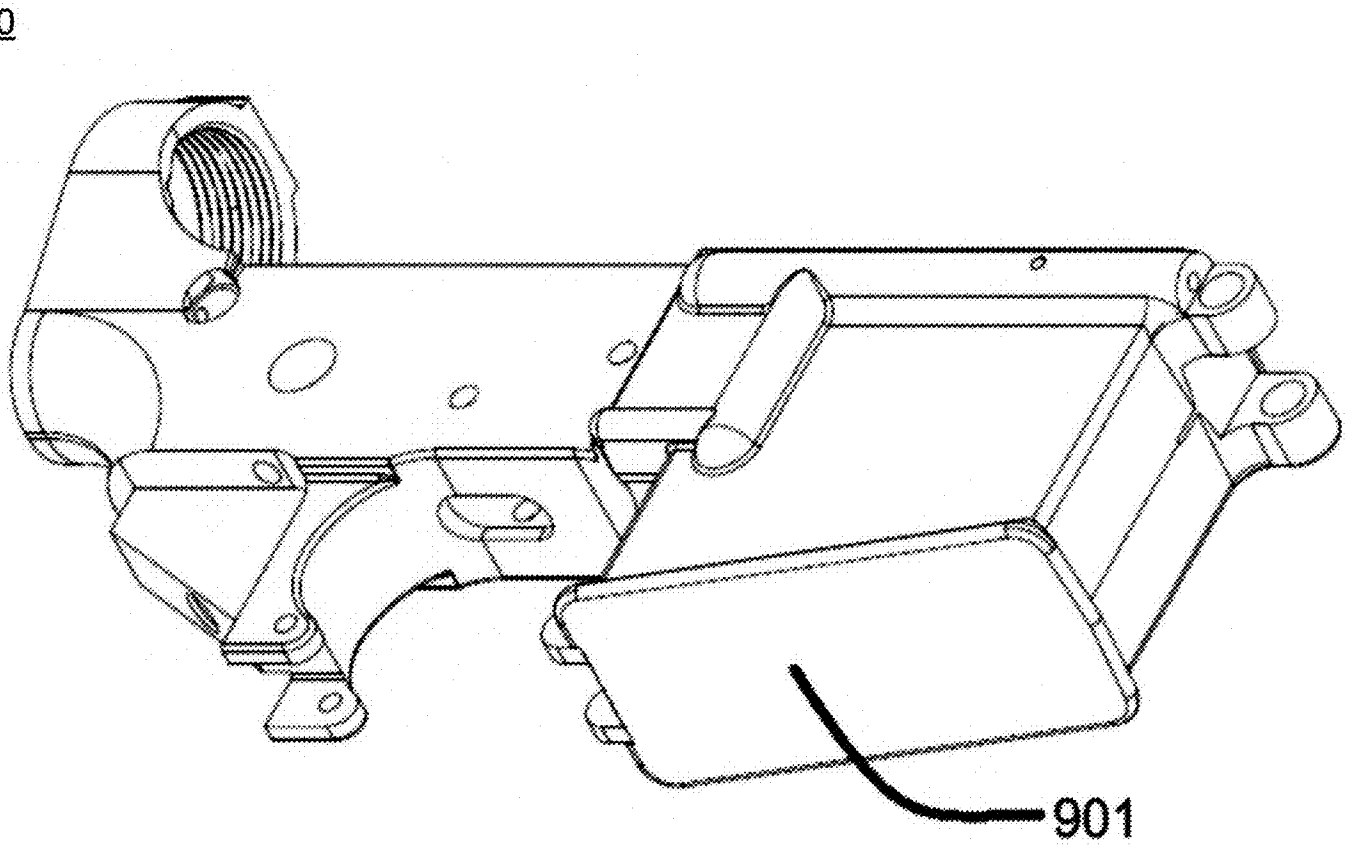
FIG. 9 shows a lower assembly of a semi-automatic firearm with a fully closed bottom that cannot accept a firearm magazine from the bottom of the firearm.

FIG. 9 shows a firearm lower assembly with a closed bottom. This is also designed to prevent a firearm magazine from being inserted from the bottom of the firearm lower assembly. In some embodiments, any size of firearm magazine may be used with this closed bottom firearm lower assembly ranging from 1 to 100 rounds. In some embodiments firearm magazines with 10 or less rounds of ammunition may be used with this closed bottom firearm lower assembly.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that various other modifications may be made in the embodiment chosen for illustration or to the general inventive concept described herein without departing from the spirit and scope of the invention as defined by the claims.

What is claimed is:

1. A firearm apparatus, comprising:

(a) a firearm upper assembly and a firearm lower assembly, (b) the firearm lower assembly comprising a firearm magazine container, wherein swapping of or refilling of a firearm magazine resident within the firearm magazine container necessitates at least partial removal of the firearm upper assembly from the firearm lower assembly and further, requires removal of a retaining device from the lower assembly that engages with and secures a firearm magazine lock wherein the retaining device is inaccessible without the at least partial removal of the firearm upper assembly from the firearm lower assembly.

2. The firearm apparatus according to claim 1 wherein the firearm magazine container has a closed inaccessible bottom end and an opening in the top end for receiving a firearm magazine.

3. The firearm apparatus according to claim 1 wherein refilling of or swapping of a firearm magazine present within the magazine container necessitates complete removal of the firearm upper assembly from the firearm lower assembly.

4. The firearm apparatus according to claim 1 wherein the firearm lower assembly or the firearm magazine container is made from a resilient material.

5. The firearm apparatus according to claim 4 wherein the resilient material is a metal.

6. The firearm apparatus according to claim 4 wherein the resilient material is a polymer.

7. The firearm apparatus according to claim 4 wherein the resilient material comprises a mixture of a metal and a polymer.

8. The firearm apparatus according to claim 1 wherein the firearm magazine has a maximum capacity of 100 rounds.

9. The firearm apparatus according to claim 1 wherein the firearm magazine has a maximum capacity of 30 rounds.

10. The firearm apparatus according to claim 1 wherein the firearm magazine has a maximum capacity of 20 rounds.

11. The firearm apparatus according to claim 1 wherein the firearm magazine has a maximum capacity of between 1 and 10 rounds of ammunition.

12. The firearm apparatus according to claim 1 wherein the firearm magazine has a maximum capacity of 5 rounds.

13. The firearm apparatus according to claim 1 wherein the firearm apparatus is a semi-automatic rifle.

14. The firearm apparatus according to claim 9 wherein the firearm apparatus is an AR-15 or AR-16 semi-automatic rifle.

15. The firearm apparatus according to claim 1 wherein the firearm magazine container and the firearm magazine are combined into a refillable only single firearm container-firearm magazine device.

16. The firearm device according to claim 1 wherein the retaining device is a retaining screw or a retaining pin.

17. The firearm apparatus according to claim 1 wherein the firearm magazine container has a partially closed bottom end whereby a firearm magazine may not be inserted from the bottom end of the firearm magazine container, and an opening in the top end of the firearm magazine container for receiving a firearm magazine.

* * * * *